US009677252B2

(12) United States Patent
Simpson et al.

(10) Patent No.: US 9,677,252 B2
(45) Date of Patent: Jun. 13, 2017

(54) GROUND ENGAGING TOOLS

(71) Applicant: Simco Mining Products & Services Pty Ltd, Mackay (QLD) (AU)

(72) Inventors: Martin Charles Simpson, MacKay (AU); Oswald Dannhauser Zaayman, Louisville, CO (US)

(73) Assignee: SIMCO MINING PRODUCTS & SERVICE PTY LTD, Mackay (QLD) (AU)

( * ) Notice: Subject to any disclaimer, the term of this patent is extended or adjusted under 35 U.S.C. 154(b) by 72 days.

(21) Appl. No.: 14/368,076

(22) PCT Filed: Dec. 19, 2012

(86) PCT No.: PCT/AU2012/001554

§ 371 (c)(1),
(2) Date: Jun. 23, 2014

(87) PCT Pub. No.: WO2013/090994

PCT Pub. Date: Jun. 27, 2013

(65) Prior Publication Data

US 2014/0366409 A1 Dec. 18, 2014

(30) Foreign Application Priority Data

Dec. 21, 2011 (AU) ..... 2011905353

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01); *E02F 9/2883* (2013.01)

(58) Field of Classification Search
CPC ..... E02F 9/28; E02F 9/2808; E02F 9/2816; E02F 9/2825; E02F 9/2833
(Continued)

(56) References Cited

U.S. PATENT DOCUMENTS 5,469,648 A 11/1995 Jones et al.
5,709,043 A 1/1998 Jones et al.
(Continued)

*Primary Examiner* — Gary Hartmann
(74) *Attorney, Agent, or Firm* — Abelman, Frayne & Schwab

(57) ABSTRACT

A tooth for earthmoving and mining equipment, including a cutting tip; and a mounting portion rearward of the cutting tip, the mounting portion having 'a cavity therein opening to the rear and including a cone portion extending forward from the rear opening and terminating in a beak portion. The cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening. The upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side laces of the cone portion respectively, and the upper and lower faces of the beak portion being generally parallel and the side faces of the beak portion also being generally parallel and contiguous with a front face of the beak portion.

36 Claims, 22 Drawing Sheets

(58) Field of Classification Search
USPC ..... 37/452, 453, 455, 456
See application file for complete search history.

(56) References Cited

U.S. PATENT DOCUMENTS

| | | | | |
|---|---|---|---|---|
| 5,918,391 | A * | 7/1999 | Vinas Peya | E02F 9/2825 37/452 |
| 5,937,551 | A * | 8/1999 | Moehnke | E02F 3/58 37/456 |
| 5,956,874 | A * | 9/1999 | Ianello | E02F 9/2825 172/772.5 |
| 6,393,739 | B1 * | 5/2002 | Shamblin | E02F 9/2825 37/456 |
| 7,168,193 | B2 * | 1/2007 | Pallas Moreno | E02F 9/2825 37/452 |
| 7,926,207 | B2 * | 4/2011 | Lopez Almendros | E02F 9/2825 172/772 |
| 8,387,290 | B2 * | 3/2013 | Campomanes | E02F 9/2825 37/456 |
| 8,468,724 | B2 * | 6/2013 | Leslie | E02F 9/2841 172/722 |
| 8,468,725 | B2 * | 6/2013 | Leslie | E02F 9/2841 172/722 |
| 9,085,876 | B2 * | 7/2015 | Swinscoe | E02F 9/2833 |
| 9,139,984 | B2 * | 9/2015 | Chenoweth | E02F 9/2841 |
| 2004/0010949 | A1 | 1/2004 | Laguardia et al. | |
| 2004/0107608 | A1 | 6/2004 | Meyers et al. | |
| 2006/0143953 | A1 | 7/2006 | Karlsson et al. | |
| 2010/0162595 | A1 * | 7/2010 | Leslie | E02F 9/2841 37/456 |
| 2015/0013197 | A1 * | 1/2015 | Campomanes | E02F 9/2833 37/453 |
| 2016/0002893 | A1 * | 1/2016 | Haslett | E02F 9/2833 37/453 |

* cited by examiner

GROUND ENGAGING TOOLS

FIELD OF THE INVENTION

This invention relates to ground engaging tools for earthmoving and mining equipment. The invention has particular application to ground engaging tools for the cutting edge of excavator buckets and the invention will be described with particular reference to such application. However, the invention may have application to ground engaging tools for other types of equipment, for example, shovel buckets, bucket loaders, dragline buckets, bulldozer blades, drotts, bobcats, and backhoes.

BACKGROUND OF THE INVENTION

Typically, excavator buckets and the like have a base or floor with a cutting edge or lip to which ground engaging tools are fitted to engage the ground or spoil which is to be excavated or loaded as the case may be and to protect the lip from wear. Commonly, the ground engaging tools have a number of components. The first component, often called the nose, nose base, nosepiece or nose mount, is usually fixed in a permanent or semi-permanent manner to the base of the bucket by welding and protrudes forward from the lip. The second component is releasably mounted on or to the nose so that it can be replaced when it reaches a predetermined wear condition. In some types of equipment the second component is the cutting tip, tooth or tooth point which engages the ground at its front edge and suffers the main wear, while in other equipment, the second component is an adaptor to which a third component being the cutting tip or tooth is releasably fitted which in turn suffers the main wear while the adaptor suffers lesser wear. Thus, it will be understood that while the tooth in a three component system will have a much shorter life than the adaptor the adaptors themselves do eventually wear out and have to be replaced. Even the nose may wear out long before the bucket floor and walls and have to be replaced but in the case of the nose, it can be cut away from the base and replaced by new noses which can be welded to the base but that requires substantial downtime for a fairly substantial operation. In the case of a two component system, while the releasable tooth can be replaced relatively easily, if the nose wears out, a fairly substantial operation is required to replace it as with a three component system.

Typically, the nose includes a forwardly extending protuberance which is adapted to engage in a complementary cavity provided in the tooth or the adaptor in a three component system. In some prior art systems, the protuberance includes a tapered portion which is often referred to as the "cone". In this specification, the term "cone' is also used to refer to the tapered portion even though it may not be conical in shape.

In a two component system, the adaptor has a cavity opening at one end in which the complementary protuberance on the nose engages and a protuberance at the other end which is adapted to engage in the complementary tooth cavity. The two components are commonly releasably secured together by one or more locking pins which lock the tooth and the underlying adaptor together or the adaptor and the underlying nose in the case of a three component system. There are various securing systems available which are commonly referred to as retaining systems.

In one known retainer system, a tapered pin is driven through aligned holes extending through the tooth and the adaptor from top to bottom or the adaptor and the nose.

However, the hole causes a weakness in the nose or the adaptor in a three component system which leads to failure. In another case, two opposed relatively short locking pins located in the nose are arranged to be extended into complementary holes or openings in the opposed side walls of the tooth or adaptor mounted on the nose.

It will be appreciated that the cavities and protuberances are shaped to inhibit relative movement between the engaging components when in operation, although the presently known systems do not inhibit relative movement as well as desired. Further, the presently available retaining systems do not provide the reliability or efficiency of operation desired.

In this specification, unless the context clearly requires a different meaning, the term forward and its derivatives are to be understood as being in the direction of movement of the tooth or bucket when digging or filling the bucket with spoil. Terms such as upper, lower, side, front, rear, and the like are to be understood in the context of the tooth digging so that the leading edge of the tooth is the front of the tooth.

OUTLINE OF THE INVENTION

With the foregoing in view, the invention resides broadly in a nose mount and complementary tooth in combination for earthmoving and mining equipment, the nose mount having a base for securing the nose mount to the lip of a bucket and a protuberance extending forwardly therefrom, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the base so that the curved corner faces diminish away from the base, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel, the tooth having a cutting tip at its front and a mounting portion rearward of the cutting tip, the mounting portion having a cavity therein opening to the rear, and the cavity including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion, the nose mount and the tooth being so made and arranged that the beak portion of the protuberance substantially engages in the beak portion of the cavity with the upper and lower faces and side faces of the beak portion of the protuberance engaging with the upper and lower faces and side faces of the beak portion of the cavity, and the upper and lower faces and side faces of the cone portion of the nose mount engaging with the upper and lower faces and side faces of the cone portion of the cavity.

In another aspect, the invention resides broadly in a nose mount and complementary adaptor in combination for earthmoving and mining equipment, the nose mount having a base for securing the nose mount to the lip of a bucket and a protuberance extending forwardly therefrom, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the base so that the curved corner faces diminish away from the base, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel, the adaptor including a mounting portion for mounting the adaptor on the nose mount and a nose portion extending forwardly from the mounting portion for mounting a tooth thereon, the mounting portion having a cavity therein opening to the rear, the cavity including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other away from the rear opening and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion, the nose mount and the adaptor being so made and arranged that the beak portion of the protuberance substantially engages in the beak portion of the cavity with the upper and lower faces and side faces of the beak portion of the protuberance engaging with the upper and lower faces and side faces of the beak portion of the cavity, and the upper and lower faces and side faces of the cone portion of the nose mount engaging with the upper and lower faces and side faces of the cone portion of the cavity.

In yet another aspect, the invention resides broadly in a tooth for earthmoving and mining equipment, including:

a cutting tip; and a mounting portion rearward of the cutting tip, the mounting portion having a cavity therein opening to the rear and including a cone portion extending forward from the rear opening and terminating in a beak portion, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion.

In yet another aspect, the invention resides broadly in an adaptor for earthmoving and mining equipment, the adaptor including:

a mounting portion for mounting the adaptor on a nose mount connected to the lip of a bucket and a protuberance extending forwardly from the mounting portion for mounting a tooth thereon, the mounting portion having a cavity therein opening to the rear and including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion, and the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the mounting portion so that the curved corner faces diminish away from the mounting portion, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel.

In yet another aspect, the invention resides broadly in an adaptor for earthmoving and mining equipment, the adaptor including:

a mounting portion for mounting the adaptor on a nose mount connected to the lip of a bucket and a protuberance extending forwardly from the mounting portion for mounting a tooth thereon, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the mounting portion so that the curved corner faces diminish away from the mounting portion, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel.

In yet another aspect, the invention resides broadly in an adaptor for earthmoving and mining equipment, the adaptor including:

a mounting portion for mounting the adaptor on a nose mount connected to the lip of a bucket and a protuberance extending forwardly from the mounting portion for mounting a tooth thereon, the mounting portion having a cavity therein opening to the rear and including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion.

In yet another aspect, the invention resides broadly in a nose mount for earthmoving and mining equipment, including:

a base for mounting the nose mount to the lip of a bucket; and a protuberance extending forwardly from the base, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the base so that the curved corner faces diminish away from the base, the upper and lower faces and the side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion.

Preferably, the protuberance and the cavity are symmetrical about a vertical plane extending from the upper face to the lower face (the vertical symmetrical plane). It is also preferred that the protuberance and the cavity be symmetrical about a horizontal plane extending from the front face of the beak portion to the mounting portion in the case of an adaptor or the base in the case of a nose mount in the central part (the horizontal symmetrical plane). It that respect, it will be appreciated that the curved corner faces joining the upper face to the side faces and the lower face to the side faces may have different radii.

Preferably, the front face of the beak portion of the protuberance and the cavity is generally planar.

Preferably, the upper and lower faces of the cone portion of the nose and the cavity each include a substantially planar centre portion which is contiguous with the curved corner portions on opposite sides thereof. However, in a particularly preferred form, the protuberance includes a keying ridge forming opposed keying shoulders with the lower face of the cone portion and depending therefrom.

Preferably, the adaptor and the tooth have an opening in each side of the mounting portion thereof for mounting a lock therein for use in releasably securing the mounting portion to an adaptor or a nose mount in the case of a tooth or a nose mount in the case of an adaptor. In a preferred form, the openings are centred on a transverse axis passing through a horizontal plane about which the adaptor and tooth are each substantially symmetrical as previously mentioned.

Preferably, the cone portion of the protuberance of the nose mount and the adaptor has an opening in each side thereof for receiving therein a retaining lug, pin or the like from a lock mounted in the mounting portion of an adaptor or tooth for securing an adaptor to a nose mount or a tooth to an adaptor as the case may be. In a particularly preferred form such openings are blind holes centred on a transverse axis passing through the horizontal symmetrical plane and substantially coaxial with the corresponding axis passing through aligned complementary holes formed in the tooth or adaptor as the case may be as previously described.

Preferably, the base of the nose mount and the mounting portion of the adaptor include spaced apart recesses (ear pockets) adapted to provide respective load bearing faces adjacent the side faces for transferring pushing loads from the nose mount or the adaptor as the case may be to the tooth or the adaptor when the adaptor is fitted to a nose mount. In a preferred form in which complementary holes are formed in the sides of the nose mount, such bearing faces are orthogonal to the vertical symmetrical plane and part cylindrical in form and centred on the transverse centre axis of such complementary holes. Advantageously, such ear pockets allow the tooth and the adaptor to have complementary projections or ears to be provided about the holes in the sides thereof to provide sufficient strength in that area and such complementary projections are arranged to engage the respective load bearing faces. Advantageously, it is preferred that the projections be arranged to engage the side faces of the cone portion to assist in inhibiting relative movement between the adaptor or the tooth and the nose mount or between the tooth and the adaptor.

In yet another aspect the invention resides broadly in a nose mount having a base for securing the nose mount to the lip of a bucket and a protuberance extending forwardly therefrom, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the base so that the curved corner faces diminish away from the base, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being parallel and of a predetermined length away from the base and the side faces of the beak portion also being parallel, and wherein the relative magnitude of at least one geometrical feature is selected according to predetermined ratios.

In still yet another aspect, the invention resides broadly in a tooth for earthmoving and mining equipment, the tooth having a cutting tip at its front and a mounting portion rearward of the cutting tip, the mounting portion having a cavity therein opening to the rear and including a cone portion extending forward from the rear opening and terminating in a beak portion, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, 00 and the upper and lower faces of the beak portion being parallel and the side faces of the beak portion also being parallel and contiguous with a front face of the beak portion, and wherein the relative magnitude of at least one geometrical feature is selected according to one or more predetermined ratios.

In still yet another aspect, the invention resides broadly in an adaptor for earthmoving and mining equipment, the adaptor having a mounting portion for mounting the adaptor on a nose mount connected to the lip of a bucket and a protuberance extending forwardly from the mounting portion for mounting a tooth thereon, the mounting portion having a cavity therein opening to the rear and including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being parallel and the side faces of the beak portion also being parallel and contiguous with a front face of the beak portion, and wherein the relative magnitude of at least one geometrical feature is selected according to one or more predetermined ratios.

Preferably, the one or more predetermined ratios are selected from the ratio of the width of the nose portion to the height of the nose portion adjacent the base, the length of the beak portion the length of the cone portion away from the base, the width of the upper face of the cone portion to the width of the cone portion adjacent the base, the radius of the upper corner portion adjacent the upper face of the cone portion to the radius of the upper corner adjacent the side face, the width of the cone portion adjacent the base to the radius of the upper corner portion adjacent the upper face, and the radius of the bottom corner adjacent the lower face to the radius of the upper corner portion of the beak portion.

BRIEF DESCRIPTION OF THE DRAWINGS

In order that the invention may be more clearly understood and put into practice, the invention will now be described with reference to the accompanying drawings wherein.

DETAILED DESCRIPTION OF THE DRAWINGS

Figure 1:
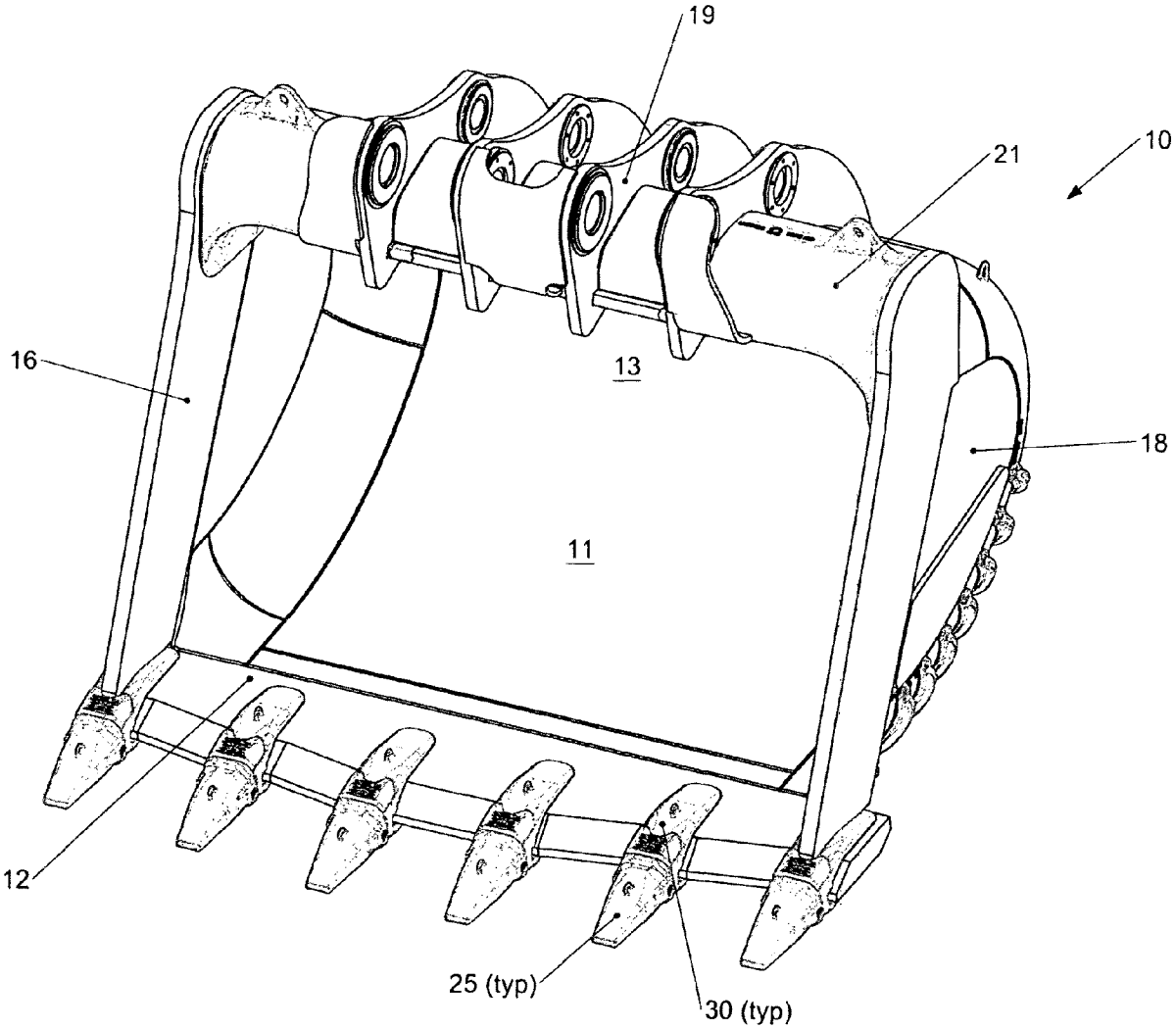
FIG. 1 is pictorial representation of an excavator bucket from the front with a plurality of teeth mounted on complementary nose mounts at the lip of the bucket.
Figure 2:
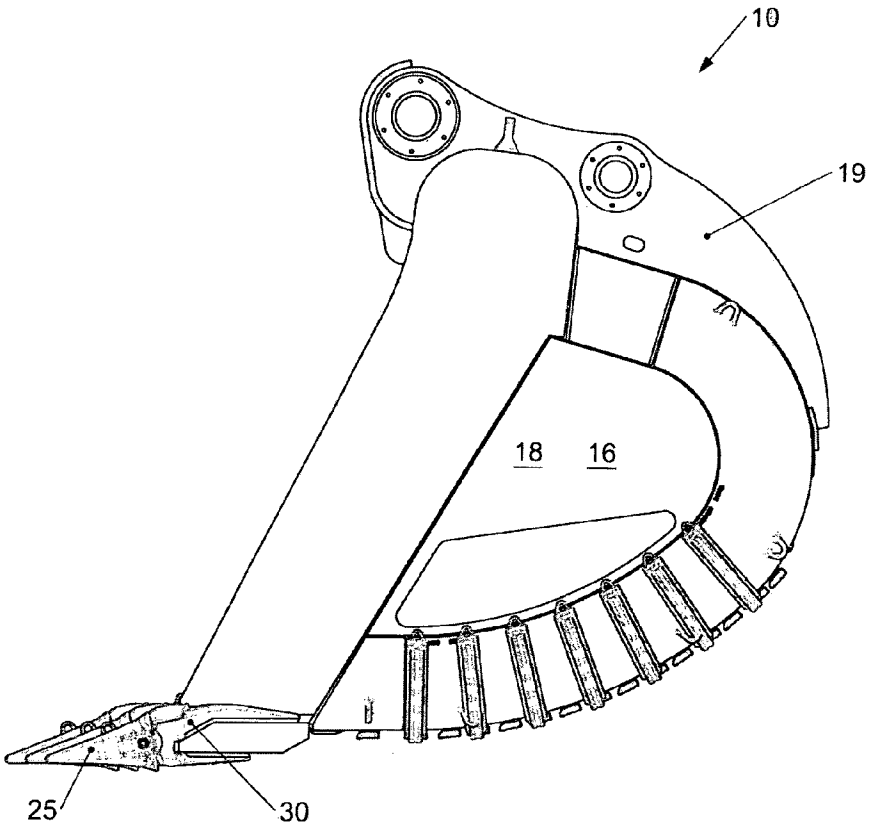
FIG. 2 is pictorial representation of the excavator bucket of FIG. 1 from its right side.
Figure 3:
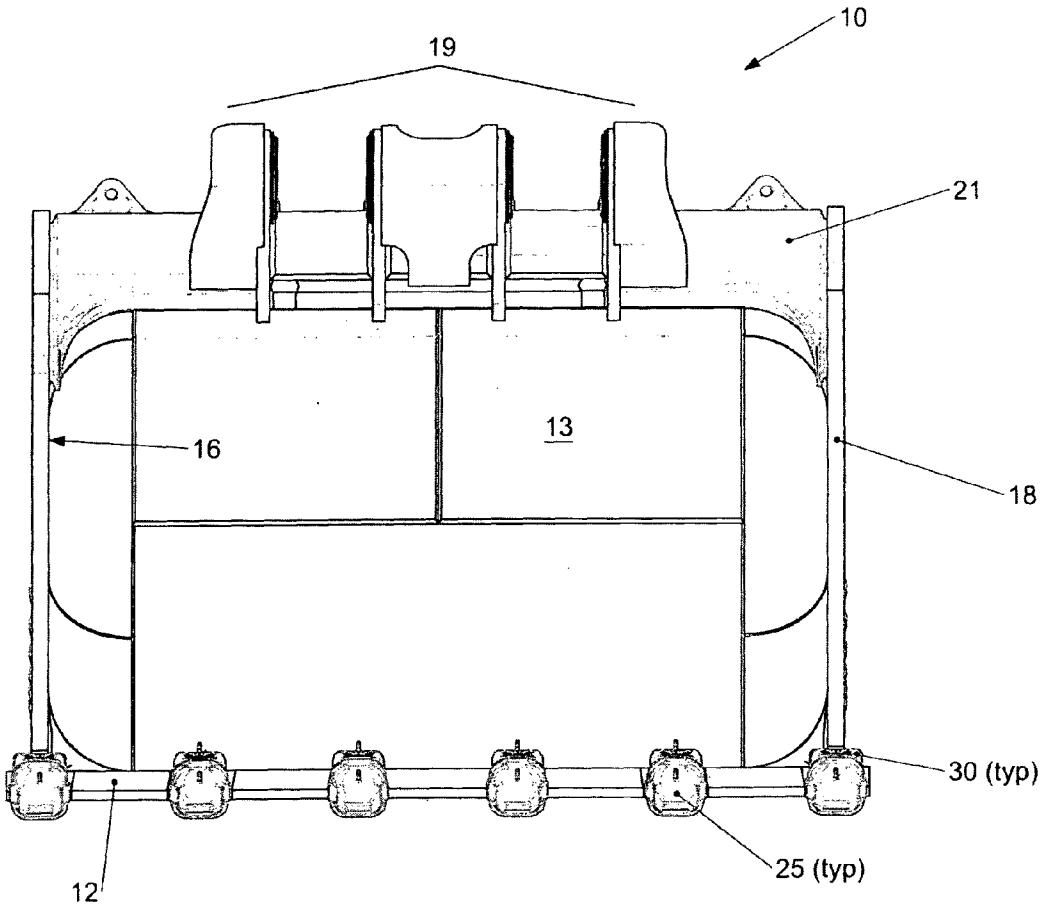
FIG. 3 is a front elevation of the excavator bucket of FIG. 1.
Figure 4:
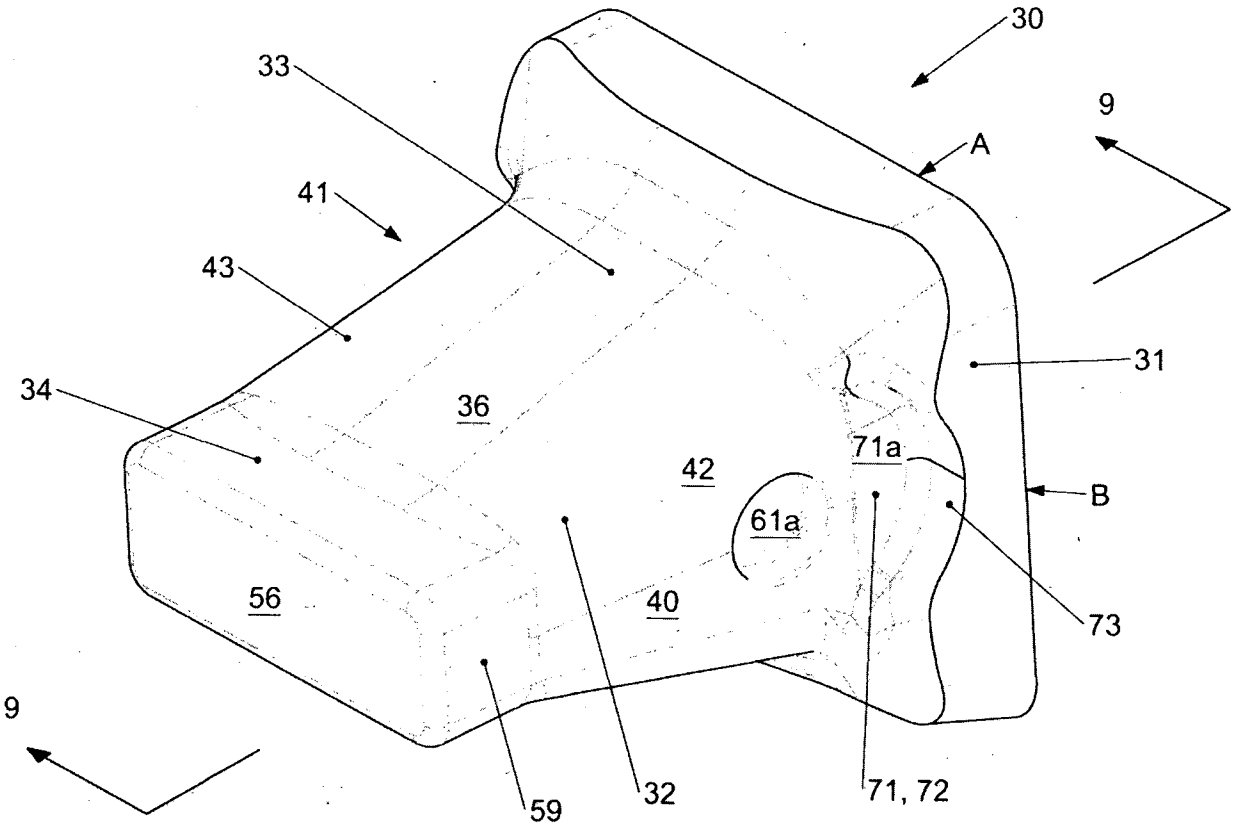
FIG. 4 is pictorial representation from above one side of a nose mount according to the invention adapted to be welded to the lip portion of an excavator bucket of the type shown in FIG. 1.
Figure 5:
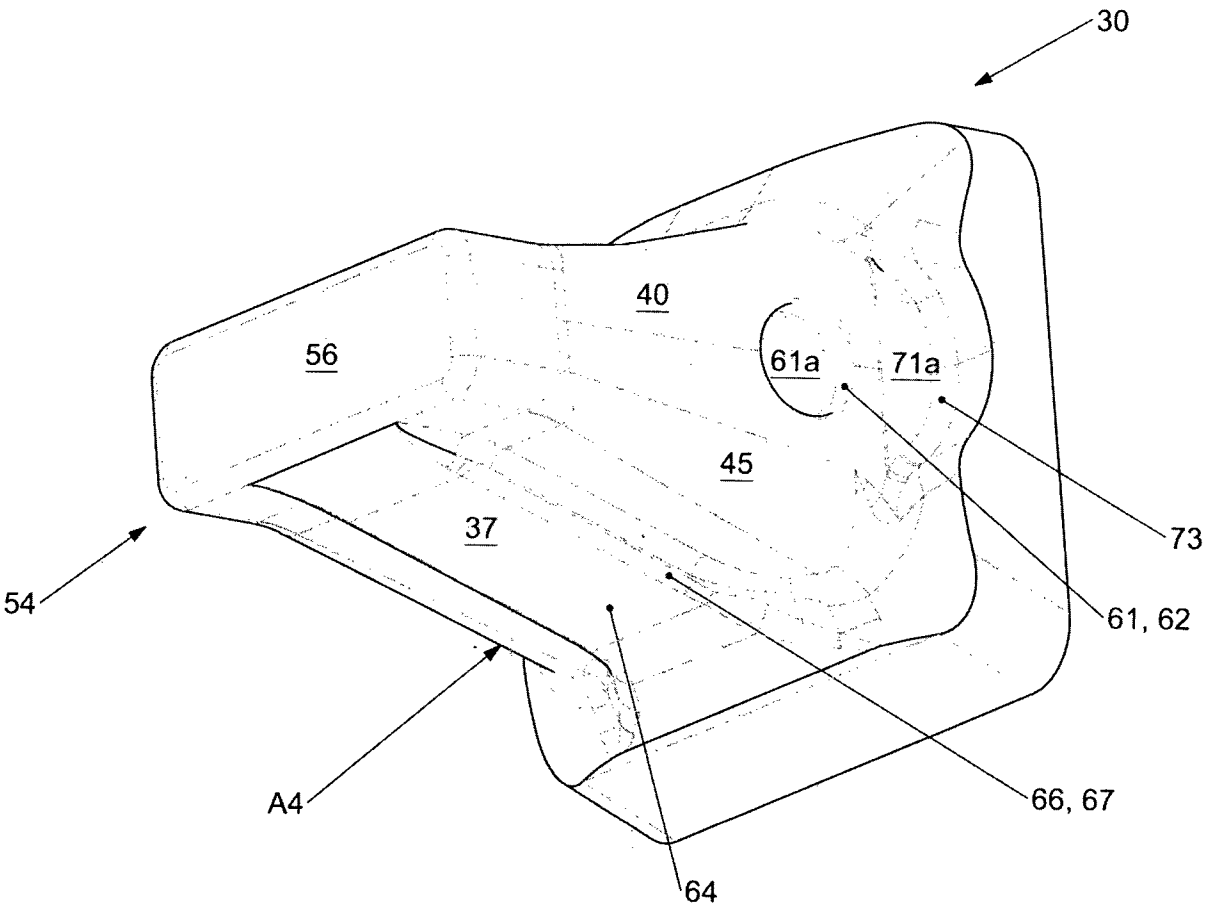
FIG. 5 is pictorial representation of the nose mount of FIG. 5 from under one side.
Figure 6:
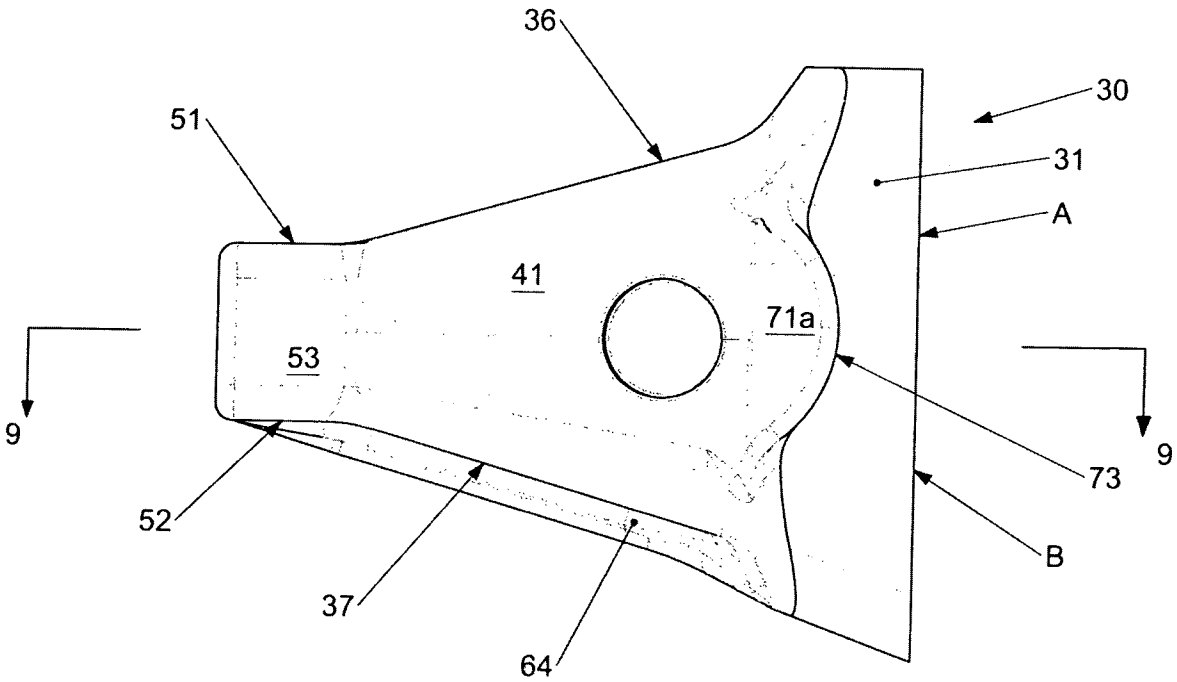
FIG. 6 is side elevation of the nose mount of FIG. 4.
Figure 7:
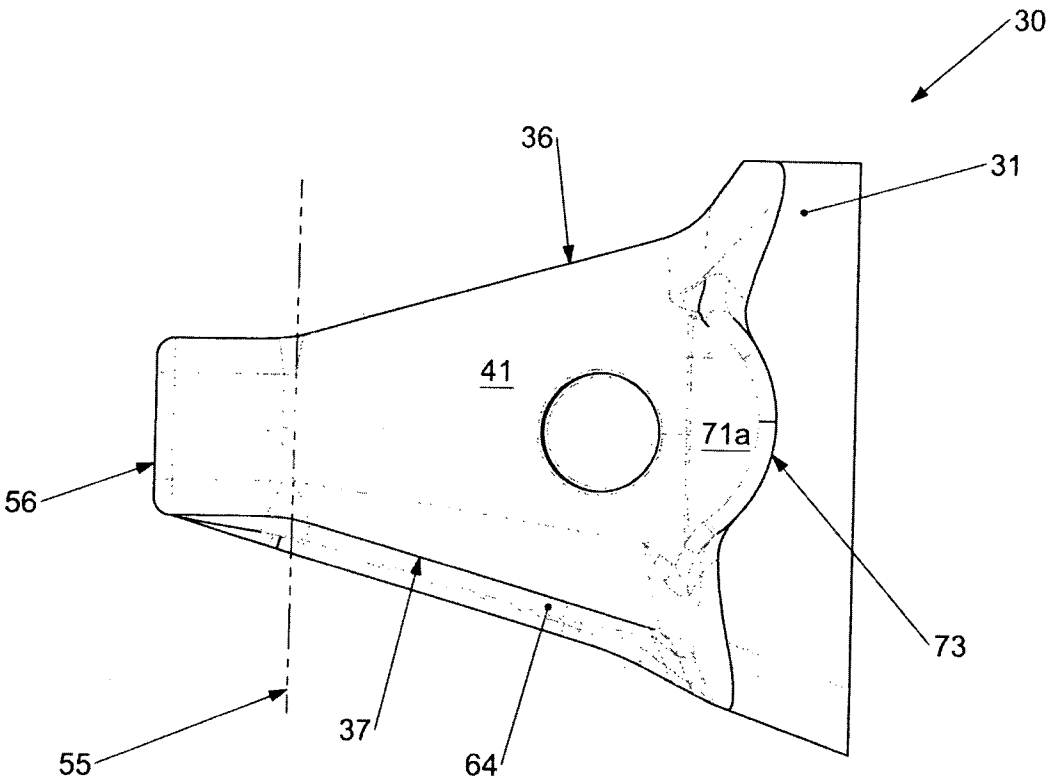
FIG. 7 is the same side elevation as FIG. 6 with some features remove for clarity.

The bucket 10 illustrated in FIG. 1 has a floor 11 with a ground engaging leading edge (or lip) 12 at its front. The floor curves upwardly behind the lip to form a contiguous rear wall 13 which in turn curves upwards and forwards to form a contiguous upper wall 14, the floor, the rear wall and the upper wall forming a generally u-shaped bucket enclosed by opposed generally planar side walls 16 and 18 with an open front 15. A curved lifting arch or bar 21 extends across the top of the bucket between the side walls and a plurality of spaced apart lifting lugs 19 are welded to the arch and the upper wall for connection of an excavator lifting arm and crowd arm thereto in known manner.

A plurality of spaced apart nose mounts 30 are welded to the bucket floor 11 across the front and extend forward from the lip 12. The nose mounts described in this embodiment are solid cast iron or steel fittings. Teeth 25 are fitted to the nose mounts as will be described in more detail later.

As can be seen in FIGS. 4 to 10, the nose mount 30 is shown cut away at its rear (the lip end) along lines A and B, the portion of the nose mount beyond lines A and B by which it is mounted to the lip of the bucket not being relevant to the present invention. It will be appreciated that the portion by which it is mounted to the floor of the bucket may have different shapes and arrangements depending on the bucket floor to which the nose mount is to be mounted. In that regard, the present invention relates to the shape of the portion of the mount which is referred to herein as base 31 and the protuberance 32 which extends therefrom.

The protuberance 32 includes a cone portion 33 extending forward from the base 31 and terminating in a beak portion 34. The cone portion is defined by upper and lower faces 36 and 37 which converge forwardly away from the base 31 and two opposed side faces 40 and 41 which also converge away from the base, the upper and lower faces being joined to the side faces by curved corner faces 42, 43, 44 and 45 which are contiguous with the upper and lower faces and the opposed side faces. It will be appreciated that the converging upper and lower faces and the converging side faces result in the corner faces diminishing away from the base towards the beak portion to a line at the beak portion.

The upper and lower faces of the cone portion converge into the opposed parallel upper and lower faces 51 and 52 respectively of the beak portion and the opposed side faces 40 and 41 of the cone portion converge into the opposed parallel side faces 53 and 54 of the beak portion at vertical plane 55. Advantageously, the upper and lower faces and the two opposed side faces of the beak portion terminate in a front face 56 which is generally planar and orthogonal to the opposed parallel side faces and the opposed parallel upper and lower faces of the beak portion.

Figure 8:
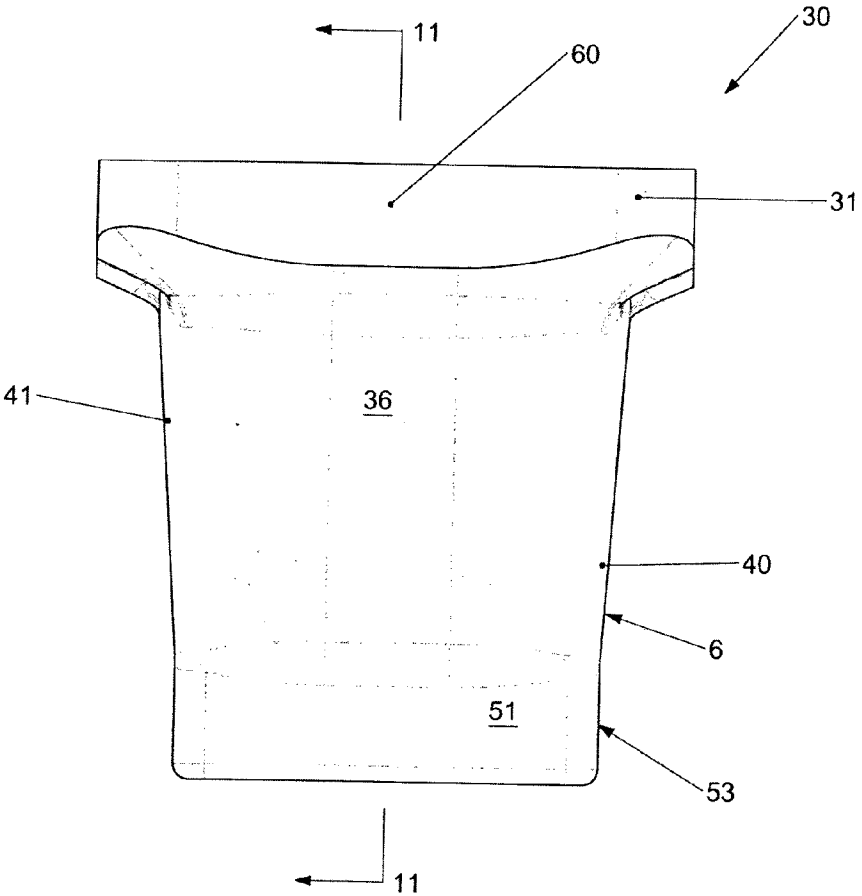
FIG. 8 is a plan of the nose mount of FIG. 4.
Figure 9:
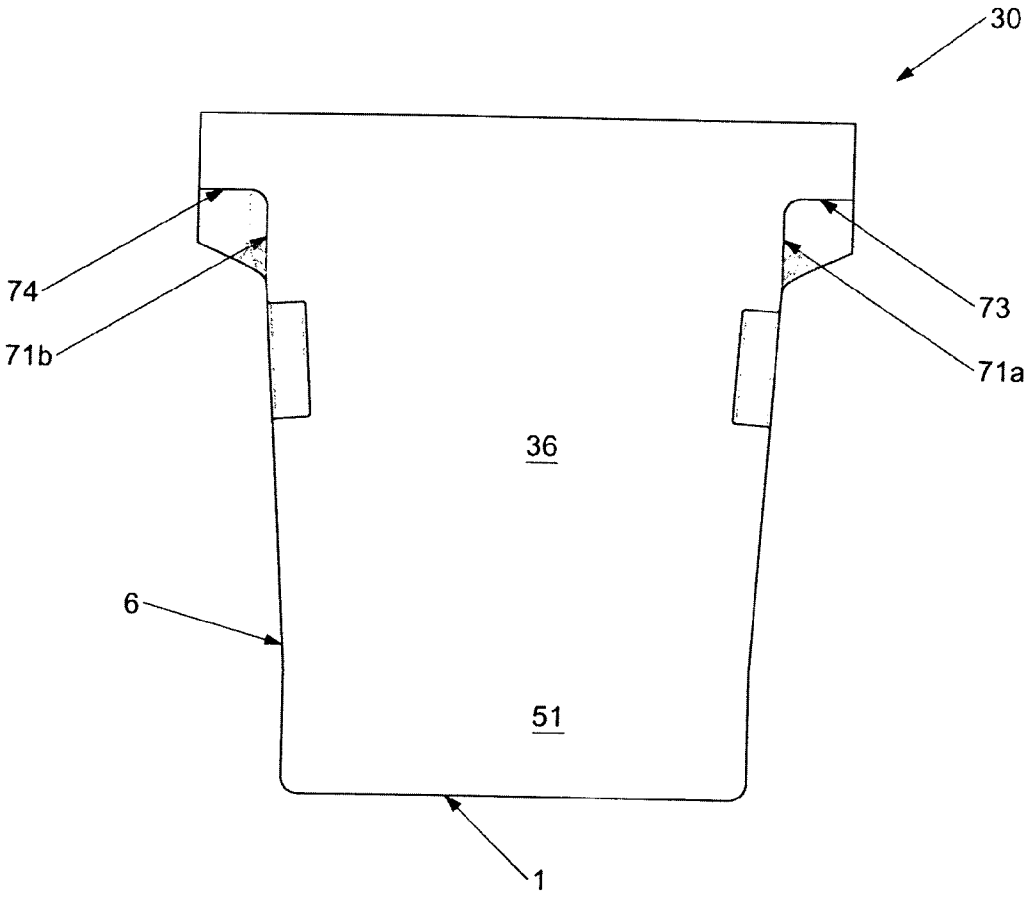
FIG. 9 is a sectional plan of the nose mount of FIG. 4 along a symmetrical horizontal plane 9-9.
Figure 10:
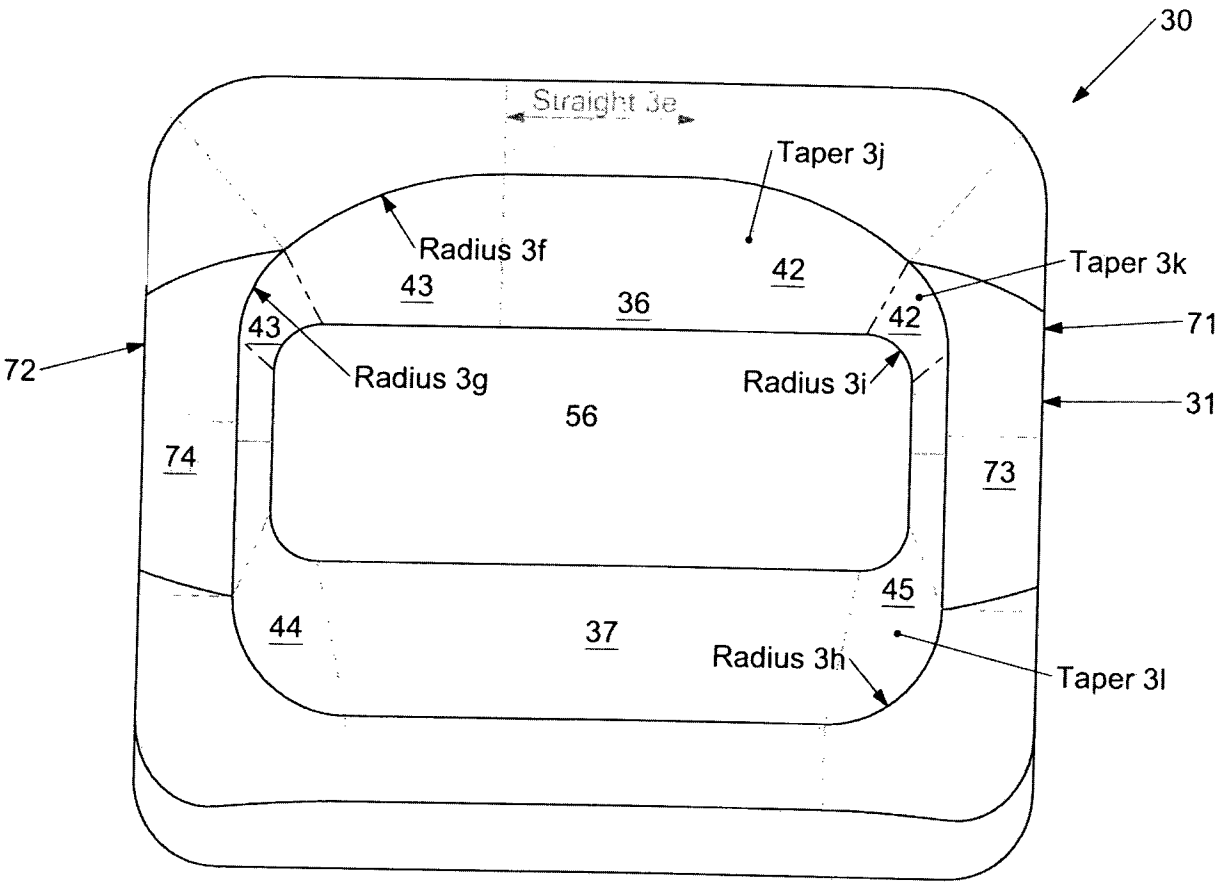
FIG. 10 is a front elevation of the nose mount of FIG. 4.
Figure 11:
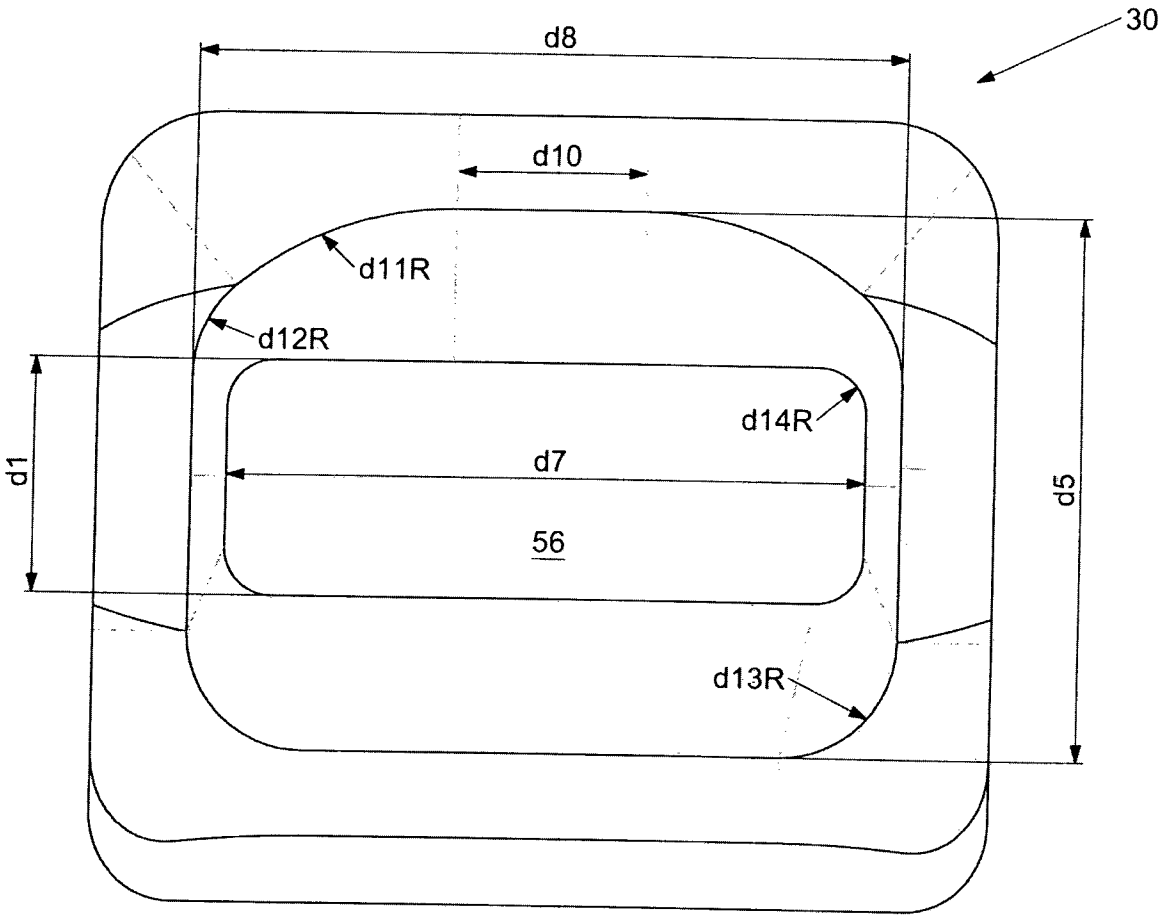
FIG. 11 is a front elevation of the nose mount of FIG. 4 with some lines removed for clarity.
Figure 12:
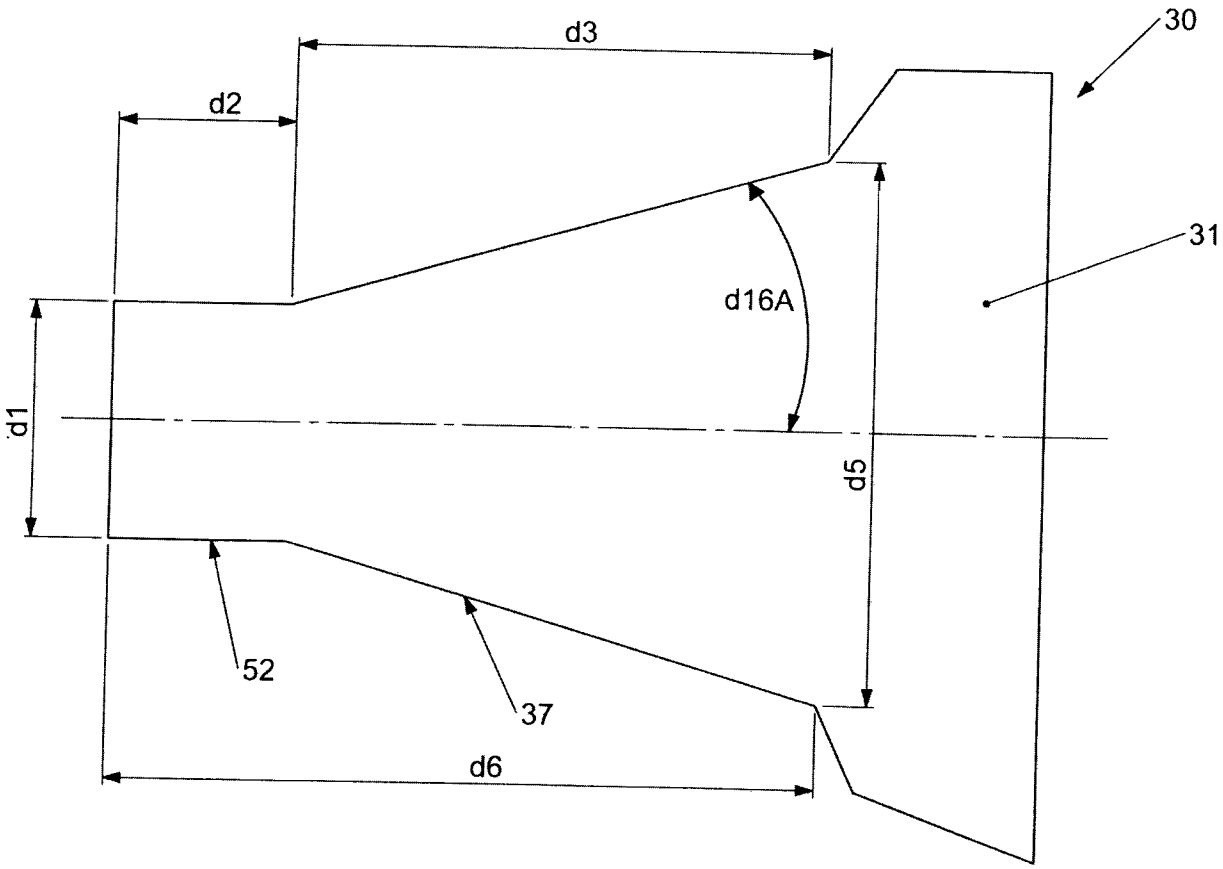
FIG. 12 is a sectional side elevation of the nose mount of FIG. 4 along a vertical symmetrical plane containing the longitudinal axis with rounds and fillets removed for clarity.
Figure 13:
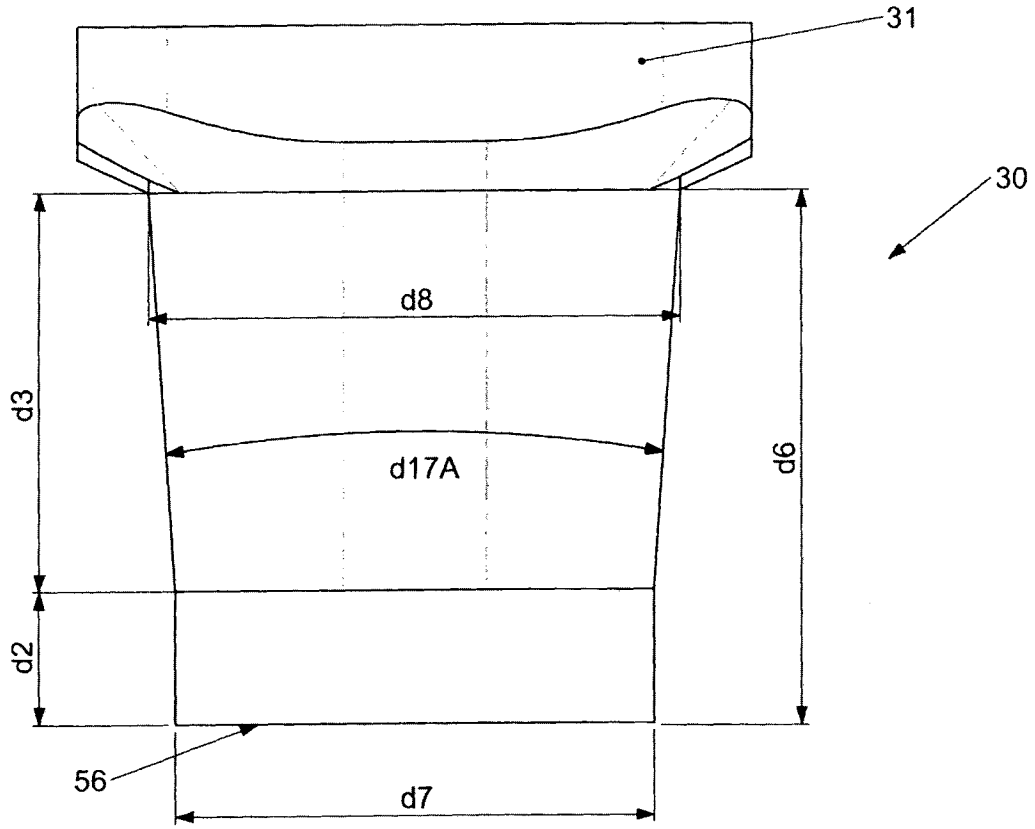
FIG. 13 is a plan of the nose mount of FIG. 4 with rounds and fillets removed for clarity.
Figure 14:
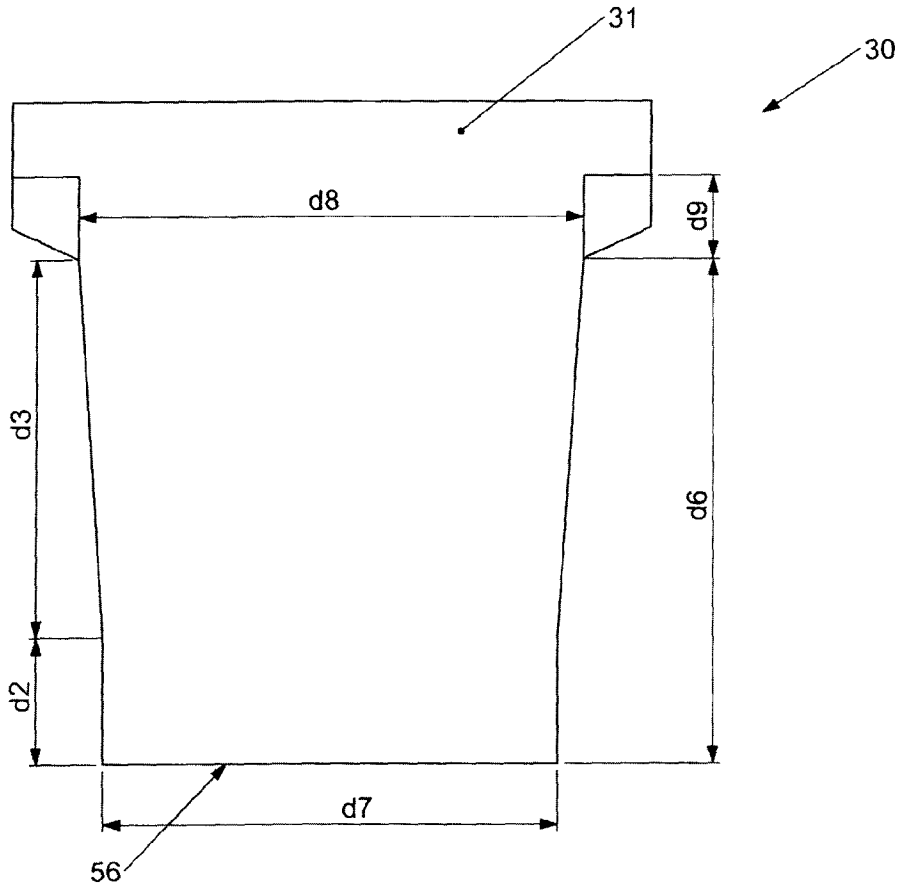
FIG. 14 is a sectional plan of the nose mount of FIG. 4 along a symmetrical horizontal plane.

It will be appreciated that the protuberance is substantially symmetrical about a substantially "horizontal" plane passing through the centreline of the front face 56 along line 9-9 and the horizontal centreline of the base 31. The term "horizontal" is used in describing the general appearance of the nose mount even though that plane might not be actually horizontal in use. It will also be appreciated that the nose mount is symmetrical about a vertical plane passing through the vertical centreline of the front face and the vertical centreline of the base along line 11-11 as can be seen in FIG. 8.

As can be seen in the drawings, opposed blind holes 61 and 62 having end faces 61*a* and 62*a* respectively are formed in the sides of the cone portion of the protuberance 32 for receiving therein retaining pins when a tooth or adaptor is mounted thereon.

It will also be seen that a keying ridge 64 depends from the lower face 37 and is centred on the vertical symmetrical plane 11-11 for the purpose of keying in a complementary slot provided in the tooth or adaptor as the case may be. Advantageously, the keying ridge has opposed parallel side faces 66 and 67 which provide shoulders against which complementary shoulders formed by the complementary slot in the tooth or adaptor can engage to inhibit sideways and rotational movement of the tooth or adaptor relative to the nose mount.

Opposed recesses 71 and 72 (sometimes referred to as ear pockets) are formed in the base 31 adjacent the side faces 40 and 41 respectively, the ear pocket recesses providing generally part cylindrical faces 73 and 74 respectively against which corresponding protuberances on the tooth may engage for transferring pushing loads from the nose mount or the adaptor as the case may be to the tooth (or the adaptor if fitted to the nose mount). Advantageously, the cylindrical faces act in conjunction with the front face 56 and the faces on the cone portion to provide a relatively large engagement surface for transmitting pushing loads and also to assist with the prevention of yawing. In that regard, the side faces of the ear pockets 71*a* and 71*b* respectively bear side loads applied by the tooth or adaptor fitted on the nose (of the adaptor or the nose mount as the case may be).

The adaptor 80 shown in FIGS. 15 to 20 includes a mounting portion (or body) 81 from which a protuberance 82 extends forward for mounting a tooth thereon as will be described more fully later. The adaptor has a cavity 83 formed in the mounting portion and opening to the rear at entry opening 84 for receiving therein the protuberance 32 of the tooth or adaptor mount 30 as previously described.

Suitably, the cavity has a shape complementary to the shape of protuberance 32 of the nose mount with a cone portion 85 extending forward from the opening 84 and terminating in a beak portion 86. It will be appreciated that the cavity is defined at least in part by the inner faces of a wall 79 extending about the top, bottom and side of the cavity. In that respect, the cone portion is defined by opposed upper and lower faces 87 and 88 which converge forwardly away from the opening 84, and two opposed side faces 89 and 90 which also converge away from the opening 84, the upper and lower faces being joined to the side faces by curved corner faces 91, 92, 93 and 94 which are contiguous with the upper and lower faces and the opposed side faces as can be seen more clearly in FIG. 19.

It will be appreciated that the converging upper and lower faces and the converging side faces result in the corner faces diminishing away from the opening 84 towards the beak portion in the same manner as the nose mount previously described. The beak portion of the cavity is defined by opposed upper and lower faces 100 and 101 and opposed side faces 102 and 103, the upper and lower faces being parallel to each other and the side faces also being parallel to each other and all four faces being contiguous with a front face 108 which is generally planar and orthogonal to the opposed parallel side faces and the opposed parallel upper and lower faces.

Suitably, the upper and lower faces and the side faces are joined by radius corner faces 104, 105, 106 and 107 and the upper and lower faces of the cone portion converge into the opposed parallel upper and lower faces 100 and 101 respectively of the beak portion. Similarly, the opposed side faces 89 and 90 of the cone portion of the cavity converge into the parallel side faces 102 and 103. As with the protuberance of the nose mount, the cavity is substantially symmetrical about a horizontal plane passing through the opening 84 and also about a vertical plane passing through the vertical centre line of the front face of the cavity 108.

Advantageously, opposed protuberances (ear lugs) 111 and 112 extend from the mounting portion rearwardly beyond the opening 84, the ear lugs providing generally part cylindrical faces 113 and 114 adapted to engage with the part cylindrical faces 73 and 74 of the ear pockets of the nose mount as previously described. It will be appreciated that the part cylindrical faces of the ear pockets engaging with the part cylindrical faces 113 and 114 of the ear lugs provides a suitable mechanism for transferring pushing loads from the nose mount to the adaptor and hence to the tooth.

A keying recess 121 is formed in the bottom wall of the mounting portion of the adaptor (or tooth as the case may be) for receiving therein the keying ridge 64 of the nose mount.

Figure 15:
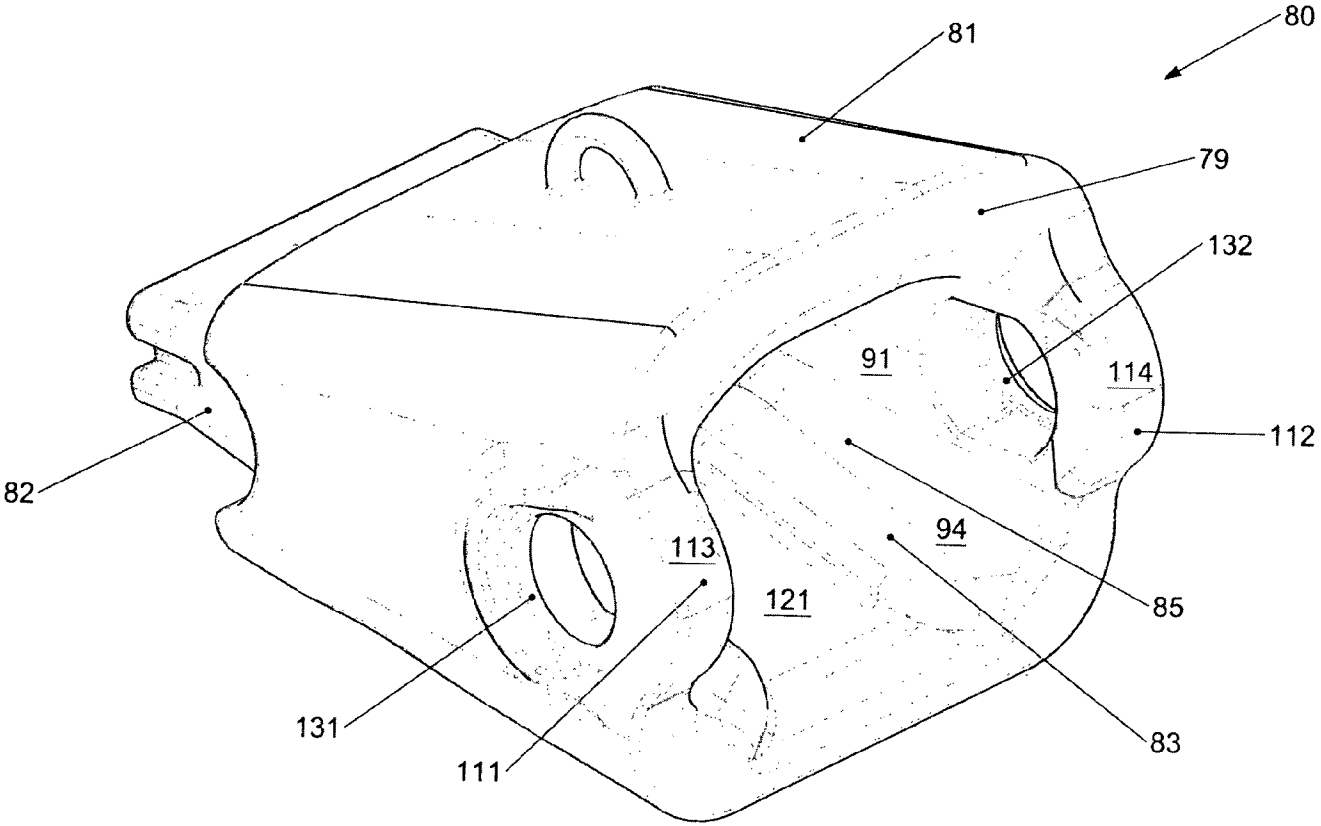
FIG. 15 is a pictorial representation of an adaptor according to the invention, the adaptor having the same features as a tooth according to the invention in its mounting portion and a cutting lip at the front end.
Figure 16:
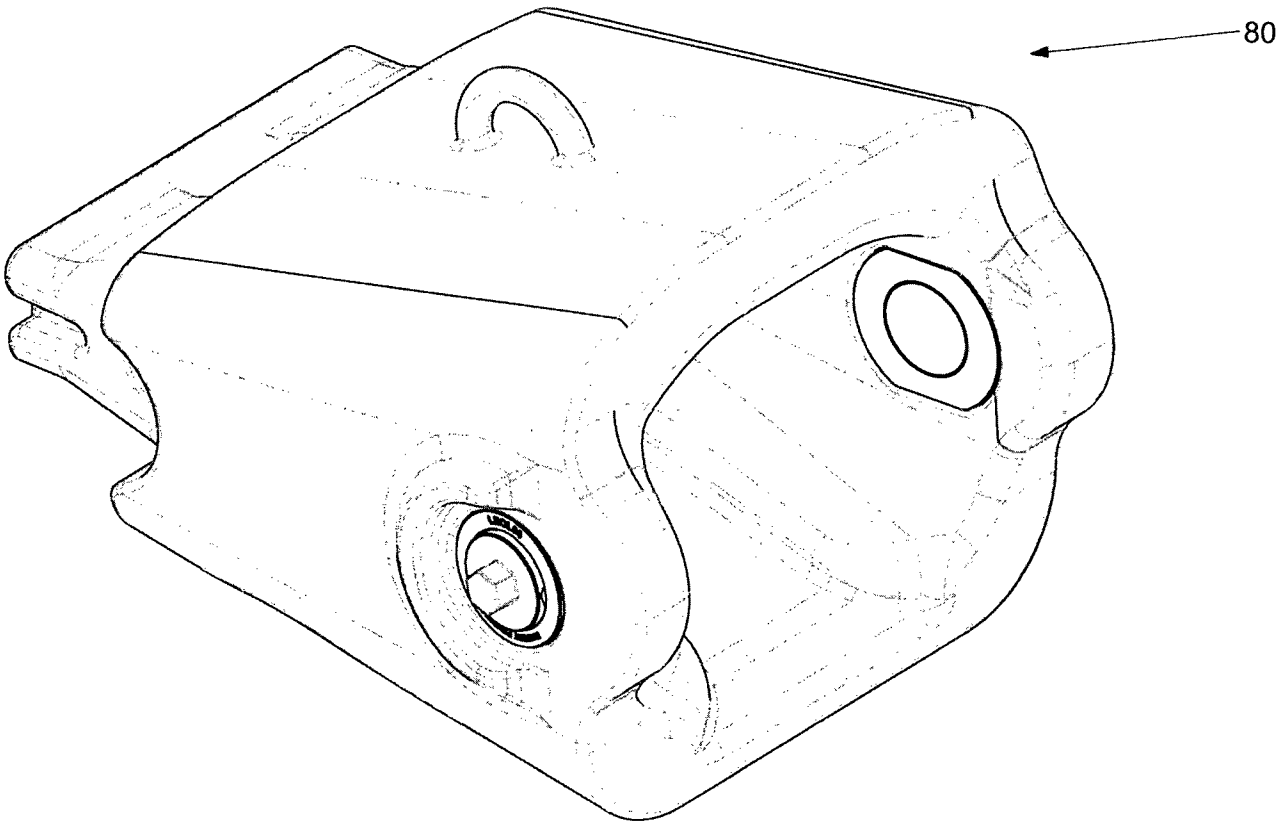
FIG. 16 is a pictorial representation of the adaptor of FIG. 15 from one side.
Figure 17:
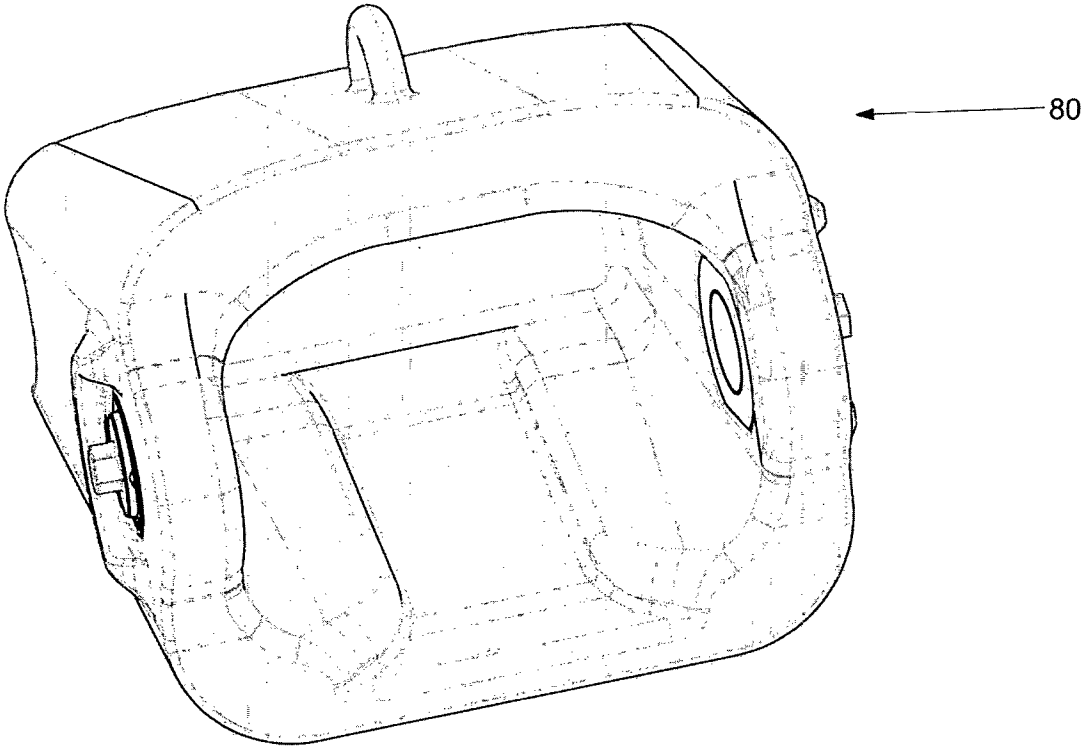
FIG. 17 is a pictorial representation of the adaptor of FIG. 15 from the rear.
Figure 18:
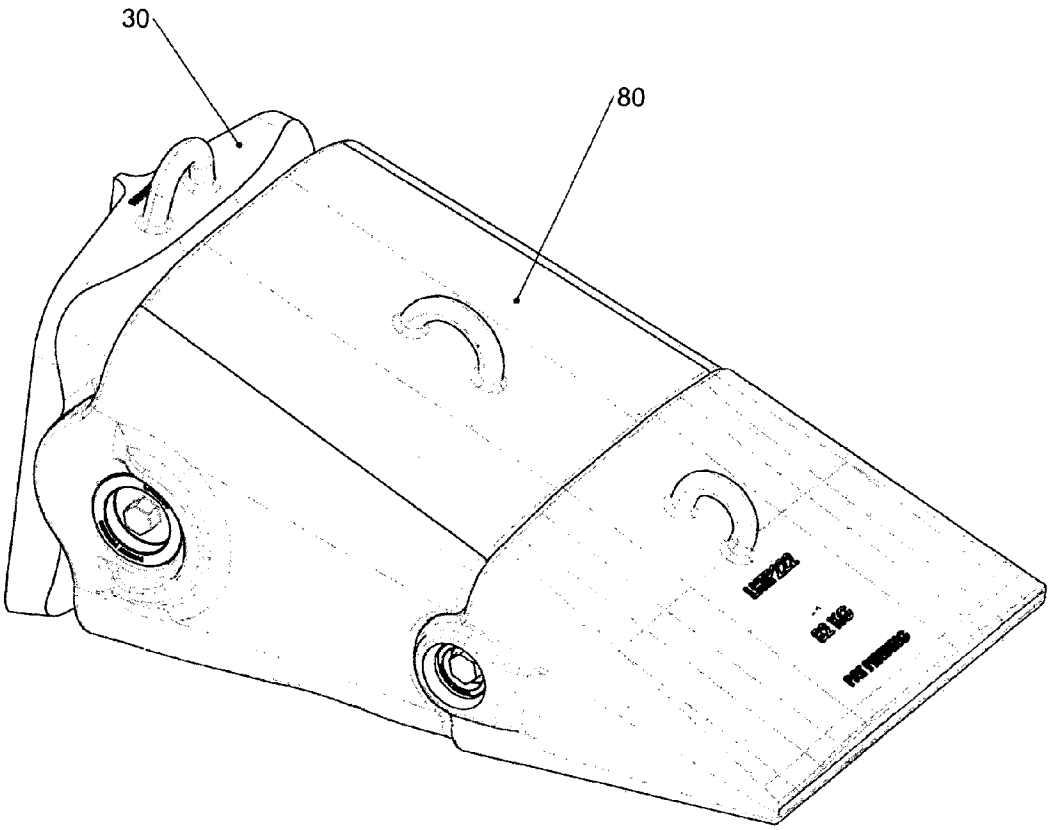
FIG. 18 is a pictorial representation of an adaptor according to the invention fitted to a nose mount according to the invention and a tooth according to the invention fitted to the adaptor.
Figure 19:
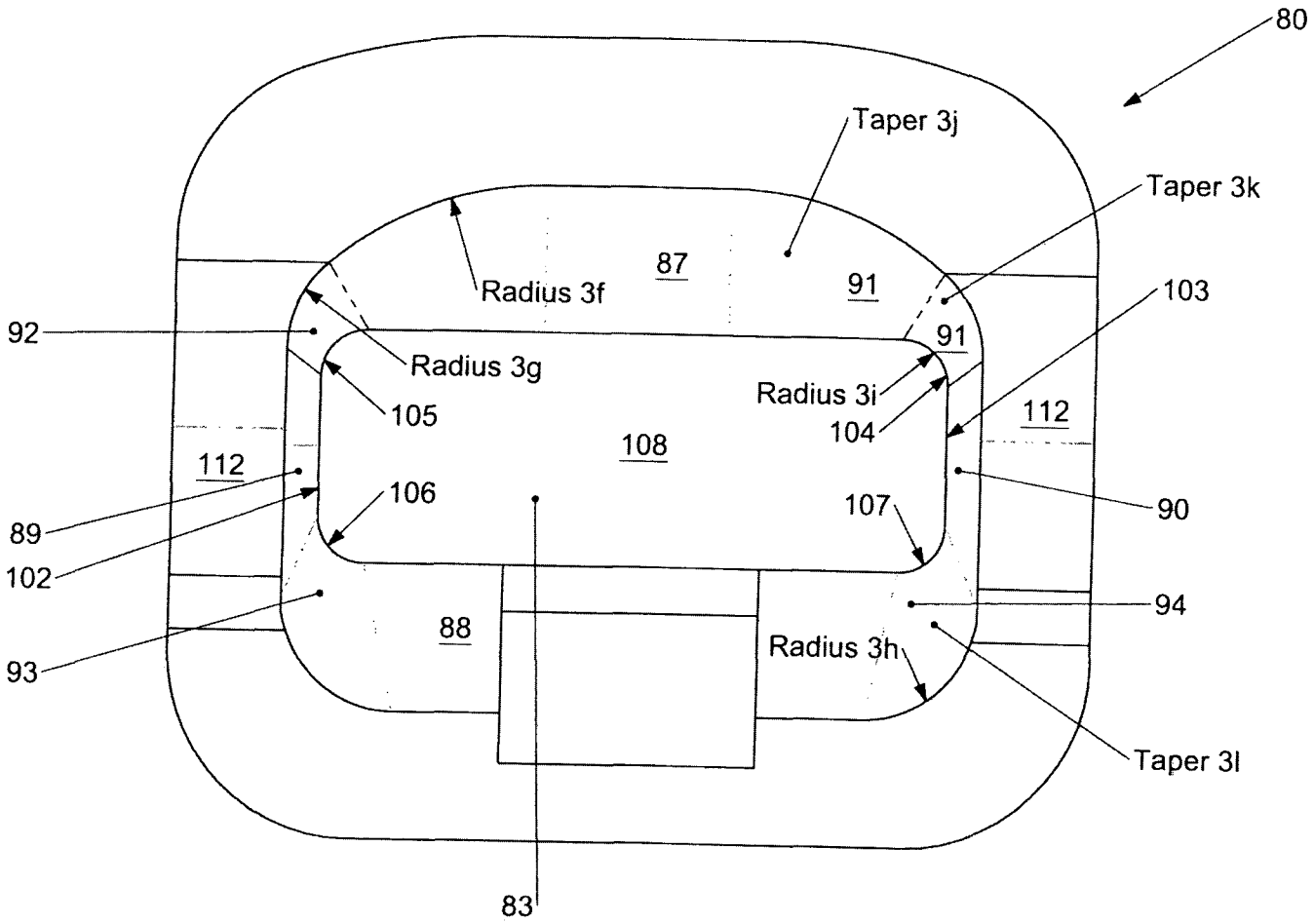
FIG. 19 is a rear elevation of the adaptor of FIG. 15.

It will also be seen in FIG. 15 that opposed through holes 131 and 132 are provided in the wall 79 of the mounting portion of the adaptor for receiving therein retaining pins for securing the adaptor to the nose mount. It will be appreciated that there are various retainer systems available which would be suitable for use with the present invention.

Figure 20:
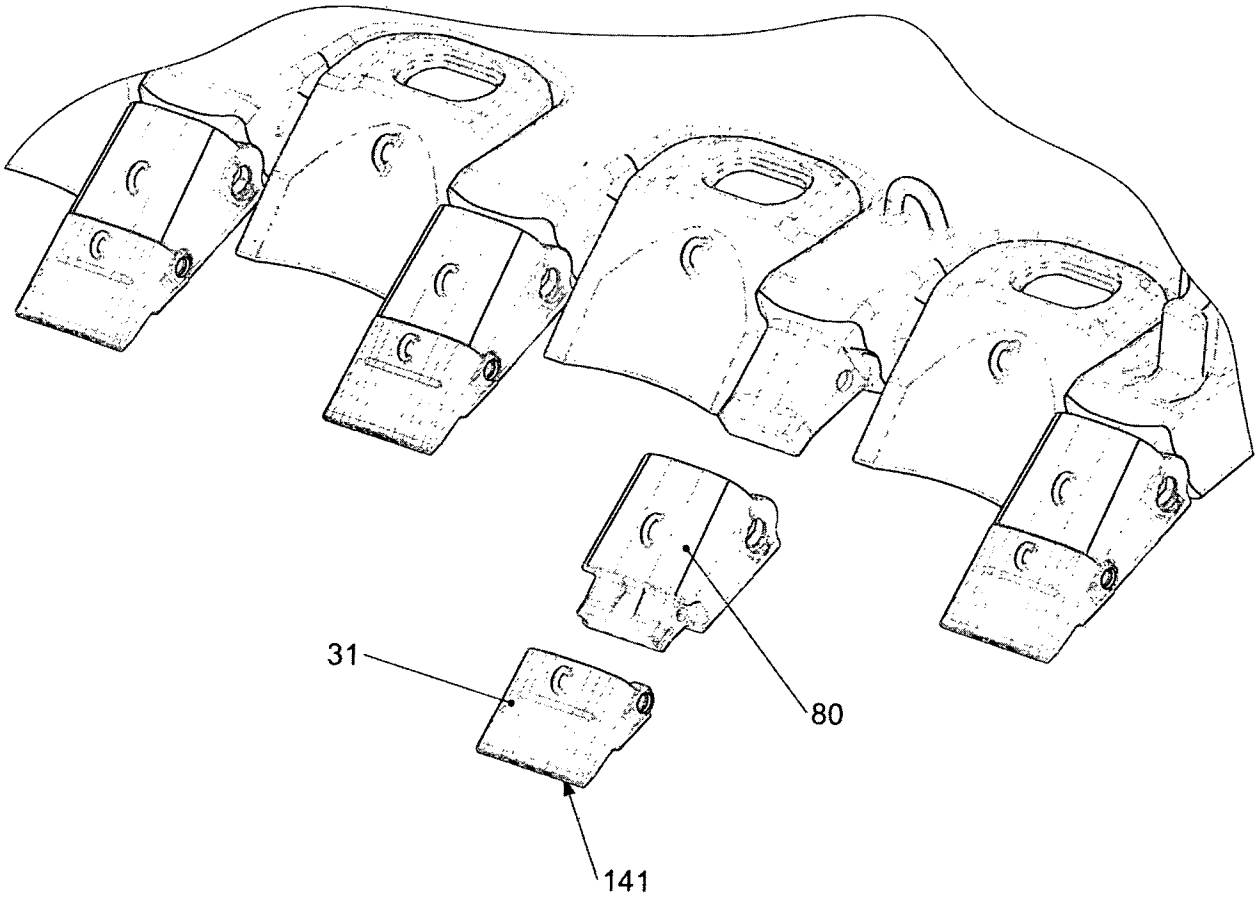
FIG. 20 is a pictorial representation of part of a bucket with nose mounts, adaptors and teeth fitted according to the invention.
Figure 21:
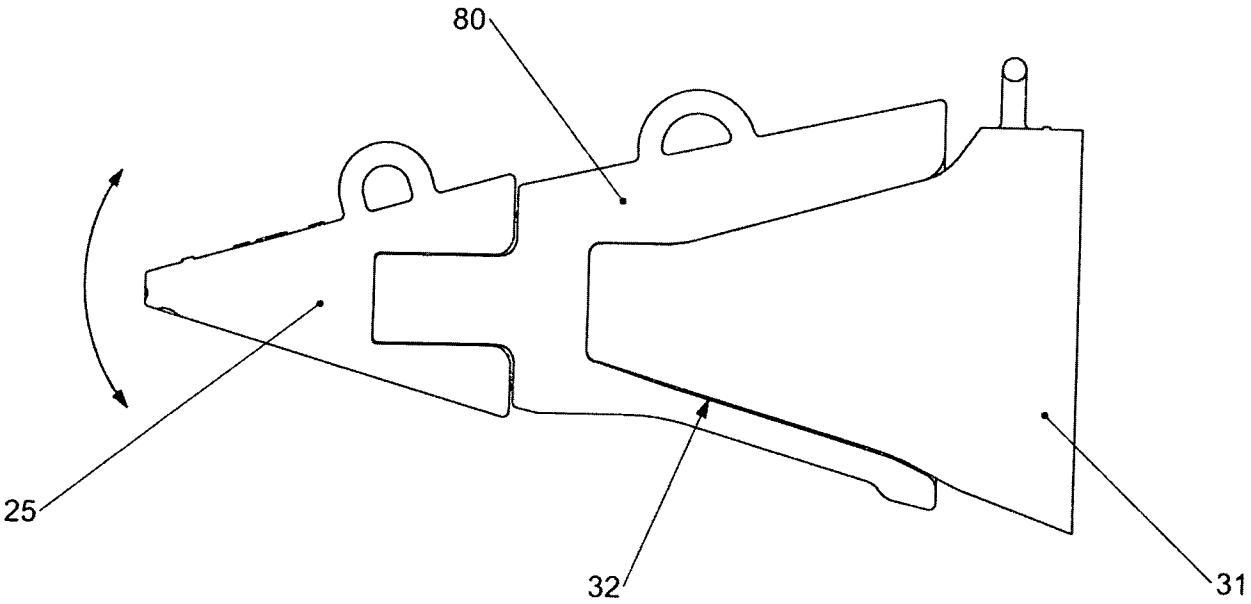
FIG. 21 is a pictorial sectional elevation along a symmetrical vertical plane of a nose mount with an adaptor mounted thereon and a tooth mounted to the adaptor according to the invention similar to the arrangement shown in FIG. 18.
Figure 22:
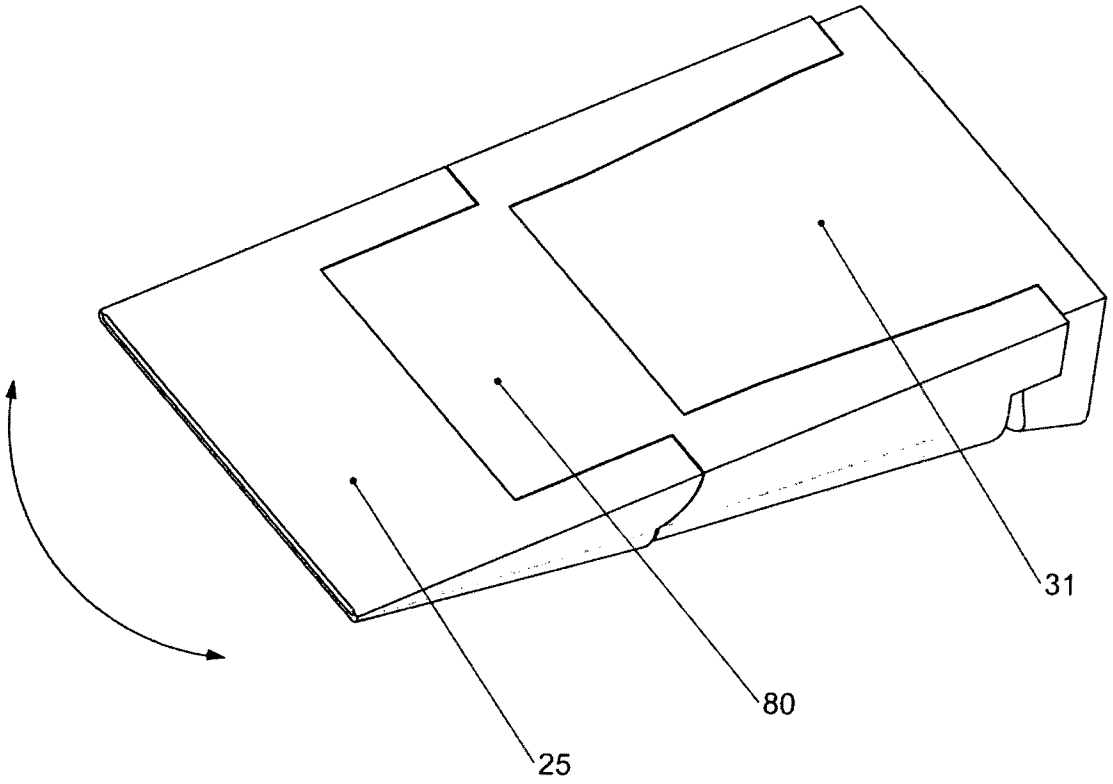
FIG. 22 is a pictorial sectional plan along a symmetrical horizontal plane of the nose mount with adaptor mounted thereon and tooth mounted to the adaptor as shown in FIG. 21.

The tooth 25 is the same as the adaptor 80 in many respects, the main difference, apart from size, being that instead of having a protuberance 82 extending forward from the mounting portion or body 81, the body terminates in a cutting edge 141. Also, as can be seen in FIGS. 15 and 20, the protuberance of the adaptor may be different from the protuberance of the nose mount with the cavity of the tooth corresponding to the different protuberance.

In use, the nose mounts 30 are welded to the floor of the bucket in the usual manner and the teeth 25 are then fitted to the protuberances of the respective nose mounts. Advantageously, as previously described, the protuberance 32 of the nose mount has a shape which is complementary to the shape of the cavity 83 formed in the tooth whereby the tooth can be pushed onto the nose mount with the protuberance engaging in the cavity with corresponding load bearing faces engaging with each other. In particular, the front face 56 of the nose mount protuberance engages the back face 108 of the cavity and carries most of the pushing load thereon. The upper and lower faces as well as the side faces of the beak portion of the protuberance are arranged to engage with the corresponding faces of the beak portion of the cavity thereby helping to maintain alignment of the tooth on the nose mount in the event of undue downward, upward or sideways forces and such loads. However, the upper and lower faces as well as the side faces of the beak portion are not intended to be load carrying faces during normal operation of the bucket 10.

The upper and lower converging faces of the protuberance as well as the opposed side faces are intended to engage with the corresponding faces of the tooth cavity and are all intended to be load carrying faces in normal operation. Similarly, the part cylindrical faces of the ear lugs and ear pockets are intended to engage and to be load carrying faces in normal forward operation of the bucket. Advantageously, the tapered curved corner faces, especially the upper corner faces are curved in a manner which prevents undesirable movement between the tooth and the nose mount thereby preventing yawing, that is, rotation of the tooth about a forwardly extending horizontal axis.

The opposed openings 131 and 132 in the tooth are arranged to align with holes 61 and 62 in the nose mount protuberance for receiving therethrough suitable pins for retaining the tooth on the nose mount. If desired, the depth of the blind holes 61 and 62 may be increased to accommodate particular styles of retaining pin or if desired, the blind holes may be drilled through the protuberance at a size to accommodate a pin extending though the tooth and the protuberance.

In this embodiment of the invention, the protuberance and the cavities have been designed according to predetermined ratios as set out in the following table and referenced to FIGS. 11 to 19:

| Ratio created by | Divided by | Value |
|---|---|---|
| Cone rear width d8 | Cone rear height d5 | 1.3 |
| Beak length d2 | Cone length d3 | 0.33 |
| Straight d10 | Cone rear width d8 | 0.2667 |
| Large taper radius d11R | Small taper radius d12R | 2.86 |
| Cone rear width d8 | Small tapered radius d12R | 6 |
| Bottom Taper radius d13R | Front Taper radius d14R | 2.5 |
| Taper angle d16A | (fixed value determined by other ratios) | 15.5°-16.5° |
| Taper angle d17A | (fixed value) | 7°-8° |

It is believed that the ratios given in the table provide a nose fit-up which optimises performance from a number of aspects. However, it is also believed that small variations from the ratios given will not significantly decrease performance and variations of up to about 20% will still result in relatively efficient and effective products.

While the foregoing description has been given by way of illustrative example of the invention, it will be understood that the invention may be embodied in many other forms and all such forms are deemed to fall within the broad scope and ambit of the invention as defined by the appended claims.

The invention claimed is:

1. First and second wear parts in combination for earth-moving and mining equipment, the first wear part including a forwardly extending protuberance, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each forwardly so that the curved corner faces diminish forwardly, and the protuberance including a downwardly extending keying ridge forming opposed spaced apart shoulders with the lower face of the cone portion, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel, and wherein the downwardly extending keying ridge extends forward to the lower face of the beak portion, the second wear part including a mounting portion with a rearwardly opening cavity therein, the cavity including a cone portion extending forward from the rear opening, the cone portion being defined at least in part by spaced apart upper and lower faces and opposed spaced apart side faces, the upper and lower faces being joined to the side faces by curved corner faces and the opposed upper and lower faces converging towards each other away from the rear opening and the opposed side faces converging towards each other away from the rear opening so that the curved corner faces diminish away from the rear opening, and an upwardly open keying recess forming opposed spaced apart shoulders with the lower face of the cone portion, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion, and wherein the upwardly open keying recess extends forward to the lower face of the beak portion of the cavity and opens to the rear opening of the cavity, the first and second wear parts being so made and arranged that the beak portion of the protuberance substantially engages in the beak portion of the cavity with the upper and lower faces and side faces of the beak portion of the protuberance engaging with the upper and lower faces and side faces of the beak portion of the cavity, and the upper and lower faces and side faces of the cone portion of the first wear part engaging with the upper and lower faces and side faces of the cone portion of the cavity, with the downwardly extending ridge engaging in the upwardly open recess such that the spaced apart shoulders of the keying ridge engage with the respective opposed spaced apart shoulders formed by the keying recess upon relative sideways movement of the second wear part on the first wear part.

2. A combination according to claim 1, wherein the protuberance of the first wear part and the cavity of the second wear part are symmetrical about a vertical plane extending from their upper faces to their lower faces respectively.

3. A combination according to claim 1, wherein the protuberance of the first wear part and the cavity of the second wear part are substantially symmetrical about a horizontal plane extending from the front face of the beak portion through the cone portion.

4. A combination according to claim 1, wherein the front face of the beak portion of the protuberance of the first wear part and the front face of the beak portion of the cavity of the second wear part are generally planar.

5. A combination according to claim 1, wherein the upper and lower faces of the cone portion of the first wear part and the cone portion of the cavity of the second wear part each include a substantially planar centre portion which is contiguous with the curved corner portions on opposite sides thereof.

6. A combination according to claim 5, wherein at least a portion of the substantially planar centre portion is on the lower face of the keying ridge and the upper face of the keying recess respectively.

7. A combination according to claim 1, wherein the mounting portion of the second wear part has an opening in each side thereof for mounting a lock therein for use in securing the mounting portion to the protuberance on which it is to be mounted.

8. A combination according to claim 7, wherein the openings are centred on a transverse axis passing through a horizontal plane about which the protuberance of the first wear part and the cavity of the second wear part are each substantially symmetrical.

9. A combination according to claim 1 wherein the cone portion of the protuberance of the first wear part has an opening in each side thereof for receiving therein a retaining lug or pin from a lock mounted in the mounting portion of the second wear part.

10. A combination according to claim 9, wherein said openings are blind holes centred on a transverse axis passing through a horizontal plane extending from the front face of the beak portion through the cone portion and substantially coaxial with the corresponding axis passing through aligned complementary holes formed in the mounting portion of the second wear part.

11. A combination according to claim 4, wherein the first and second wear parts include spaced apart recesses and lugs respectively adapted to provide respective load bearing faces adjacent the side faces for transferring pushing loads from the first wear part to the second wear part.

12. A combination according to claim 11, wherein the cone portion of the protuberance of the first wear part has an opening in each side thereof for receiving a retaining lug or pin from a lock mounted in the mounting portion of the second wear part for securing the second wear part to the first wear part and wherein the load bearing faces are orthogonal to a vertical plane extending from the upper face of the protuberance of the first wear part to the lower face of the protuberance and part cylindrical inform and centered on the transverse centre axis of the complementary holes.

13. A combination according to claim 12, wherein the second wear part includes projections extending from the cone portion and arranged to engage the side faces of the protuberance of the first wear part to assist in inhibiting relative movement between the second wear part and the first wear part.

14. First and second wear parts in combination according to claim 1 wherein the first wear part is a nose mount and the second wear part is a tooth.

15. First and second wear parts in combination according to claim 1 where the first wear part is an adapter and the second wear part is a tooth.

16. First and second wear parts in combination according to claim 1 where the first wear part is a nose mount and the second wear part is an adapter.

17. A wear part for earthmoving and mining equipment, including:

a mounting portion with a rearwardly opening cavity therein, the cavity including a cone portion extending forward from the rear opening and terminating in a beak portion, the cone portion being defined at least in part by spaced apart upper and lower faces and opposed spaced apart side faces, the upper and lower faces being joined to the side faces by curved corner faces and the opposed upper and lower faces converging towards each other and the opposed side faces converging towards each other away from the rear opening so that the curved corner faces diminish away from the rear opening, and an upwardly open keying recess forming opposed spaced apart shoulders with the lower face of the cone portion, the upper and lower faces and the side faces of the cone portion terminating in a beak portion at the front of the cavity, the beak portion being defined at least in part by opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel and contiguous with a front face of the beak portion and wherein the upwardly open keying recess extends forward to the lower face of the beak portion of the cavity and opens to the rear opening of the cavity.

18. A wear part according to claim 17 in the form of a tooth.

19. A wear part according to claim 17 in the form of an adaptor.

20. A wear part according to claim 17 wherein the cavity is symmetrical about a vertical plane extending from the upper face to the lower face.

21. A wear part according to claim 17 wherein the cavity is substantially symmetrical about a horizontal plane extending from the front face of the beak portion through the cone portion.

22. A wear part according to claim 17 wherein the front face of the beak portion is generally planar.

23. A wear part according to claims 17 wherein the upper and lower faces of the cone portion include a substantially planar centre portion which is contiguous with the curved corner portions on opposite sides thereof.

24. A wear part according to claim 17 wherein the mounting portion has an opening in each side thereof for mounting a lock therein for use in securing the wear part to a complementary wear part.

25. A wear part according to claim 24 wherein the openings are centred on a transverse axis passing through a horizontal plane about which the cavity is substantially symmetrical.

26. A wear part according to claim 17 wherein the mounting portion includes spaced apart recesses adapted to provide respective load bearing faces adjacent the side faces for receiving pushing loads.

27. A wear part according to claim 17 including:

a protuberance extending forwardly for mounting another wear part thereon, the protuberance including a cone portion defined at least in part by spaced apart upper and lower faces and opposed spaced apart side faces, the upper and lower faces being joined to the side faces by curved corner faces and the opposed upper and lower faces converging towards each other and the opposed side faces converging towards each other forwardly so that the curved corner faces diminish forwardly, the protuberance including a downwardly extending keying ridge forming opposed spaced apart shoulders with the lower free of the cone portion, the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel and the side faces of the beak portion also being generally parallel, and wherein the downwardly extending keying ridge extends forward to the lower face of the break portion.

28. A wear part for earthmoving and mining equipment, including:

a forwardly extending protuberance, the protuberance including a cone portion defined at least in part by spaced apart upper and lower faces and opposed spaced apart side faces, the upper and lower faces being joined to the side faces by curved corner faces, the upper and lower faces converging towards each other and the opposed side faces converging towards each other forwardly so that the curved corner faces diminish forwardly, the protuberance including a downwardly extending keying ridge forming opposed spaced apart shoulders with the lower face of the cone portion , the upper and lower faces and side faces of the cone portion terminating in a beak portion at the front of the protuberance, the beak portion having opposed spaced apart upper and lower faces joined by opposed spaced apart side faces, the upper face, lower face and side faces of the beak portion being contiguous with the upper face, lower face and side faces of the cone portion respectively, and the upper and lower faces of the beak portion being generally parallel, the side faces of the beak portion also being generally parallel, and wherein the downwardly extending keying ridge extends forward to the lower face of the beak portion.

29. A wear part according to claim 28 wherein the protuberance is symmetrical about a vertical plane extending from the upper face to the lower face.

30. A wear part according to claim 28 wherein the protuberance is substantially symmetrical about a horizontal plane extending from the front face of the beak portion of the protuberance through the cone portion.

31. A wear part according to claim 28 wherein the front face of the beak portion of the protuberance is generally planar.

32. A wear part according to claim 28 wherein the upper and lower faces of the cone portion include a substantially planar centre portion which is contiguous with the curved corner portions on opposite sides thereof.

33. A wear part according to claim 28 wherein the relative magnitude of at least one geometrical feature is selected according to predetermined ratios.

34. A wear part according to claim 33 wherein the one or more predetermined ratios are selected from the ratio of the largest width of the nose portion to the greatest height of the nose portion, the length of the beak portion to the length of the cone portion, the largest width of the upper face of the cone portion to the largest width of the cone portion, the radius of the upper corner portion adjacent the upper face of the cone portion to the radius of the upper corner adjacent the side face, the largest width of the cone portion to the radius of the upper corner portion adjacent the upper face, and the radius of the bottom corner adjacent the lower face to the radius of the upper corner portion of the beak portion.

35. A wear part according to claim 28 in the form of a nose mount.

36. A wear part according to claim 28 in the form of an adaptor.

* * * * *